United States Patent [19]

Szalay

[11] 4,271,635

[45] Jun. 9, 1981

[54] ICE SKATE-SHARPENING APPARATUS

[76] Inventor: John J. Szalay, 2203 Independence, Ann Arbor, Mich. 48104

[21] Appl. No.: 170,718

[22] Filed: Jul. 21, 1980

Related U.S. Application Data

[63] Continuation of Ser. No. 964,743, Nov. 29, 1978, abandoned.

[51] Int. Cl.[3] ..... B24B 9/04

[52] U.S. Cl. ..... 51/5 D; 51/98 R; 51/102; 51/109 R; 51/131.3; 51/228

[58] Field of Search ..... 51/5 D, 98 R, 102, 109 R, 51/131.3, 166 TS, 228, 72 R, 98 BS

[56] References Cited

U.S. PATENT DOCUMENTS

| | | | |
|---|---|---|---|
| 1,084,628 | 1/1914 | Hanson | 51/131.3 |
| 2,352,386 | 6/1944 | Holman | 51/131.3 X |
| 2,549,263 | 4/1951 | Thompson | 51/166 TS X |
| 2,618,911 | 11/1952 | Indge | 51/131.3 X |
| 2,696,067 | 12/1954 | Leach | 51/131.3 X |
| 3,653,160 | 11/1972 | Raikle | 51/109 R |
| 3,805,456 | 4/1974 | Williams | 51/109 R |
| 3,988,124 | 10/1976 | Babcock | 51/228 X |
| 4,078,337 | 3/1978 | Chiasson et al. | 51/228 X |
| 4,094,101 | 6/1978 | Robinson | 51/228 X |
| 4,109,419 | 8/1978 | Broadbent | 51/228 X |

*Primary Examiner*—Gary L. Smith
*Assistant Examiner*—Robert P. Olszewski
*Attorney, Agent, or Firm*—Olsen and Stephenson

[57] ABSTRACT

Ice skate-sharpening apparatus including a housing assembly carrying a vertically extending drive shaft on which a grinding wheel is mounted. Adjustable mounting means supports the housing assembly on a work table for vertical movement with respect to the work table to position the grinding wheel at a predetermined work-performing position above the work table. Drive transmission means connects the grinding-wheel drive shaft with a motor that is fixedly mounted at a position adjacent to the work table. The drive transmission means provides for the rotation of the grinding wheel in any of a plurality of vertical positions spaced above the work table. The housing assembly also carries a wheel-dressing tool which is simply moved to a wheel-dressing position.

7 Claims, 3 Drawing Figures

ICE SKATE-SHARPENING APPARATUS

This application is a continuation of application Ser. No. 964,743, filed Nov. 29, 1978, now abandoned.

BACKGROUND OF THE INVENTION

The present invention relates generally to abrasive metal-removing apparatus, and more particularly, to ice skate-sharpening apparatus employing a grinding wheel for sharpening ice skate blades.

Conventional ice skate-sharpening apparatus includes a grinding wheel directly connected to a motor which usually is fixedly mounted on a work-supporting surface such as a flat work table so that the grinding wheel rotates at a fixed location. An ice skate, either of the hockey or figure type, then is secured to a fixture which is moved on a work-supporting surface or table in a defined path contacting the ice skate blade with the grinding wheel to sharpen the blade along its particular contour. Since the grinding wheel is rotated in a fixed position, the fixture carrying the ice skate must be equipped with adjusting mechanisms capable of vertically and horizontally positioning the ice skate blade relative to the grinding wheel. Such ice skate-carrying fixtures are complex and expensive.

Other ice skate-sharpening mechanisms movably mount the grinding wheel and drive motor as a unit so that the grinding wheel itself can be moved relative to the ice skate blade. Since the drive motor is generally heavy, the operator usually encounters difficulty with the manually operated adjusting mechanisms in making minor adjustments of the position of the grinding wheel. Also, the structure carrying the grinding wheel and drive motor fails to completely dampen the vibrations generated by the motor which results in the ice skate blade being ground with a less-than-ideal surface.

It is therefore the object of the present invention to provide an improved ice skate-sharpening apparatus which is actuated to quickly and accurately adjust the grinding wheel to a work-performing position. It is a further object of the present invention to provide ice skate-sharpening apparatus having an adjustably movable grinding wheel driven by a stationary drive motor. It is a further object of the present invention to provide ice skate-sharpening apparatus including grinding-wheel dressing means which is quickly and accurately moved to positions to dress the grinding wheel.

SUMMARY OF THE INVENTION

In accordance with the present invention, ice skate-sharpening apparatus is provided consisting of a housing assembly carrying an upright grinding-wheel drive shaft on which a grinding wheel is mounted so that its axis of rotation extends in a vertical direction. The housing assembly is mounted for vertical movement on a work-supporting surface or table on which a fixture for carrying an ice skate is movably supported. Adjustable mounted means comprising fixed guide members mounted on the work-supporting surface and follower members mounted on the housing assembly interfit in telescoping relationships to permit only vertical movement of the housing assembly with respect to the work-supporting surface to locate the grinding wheel at the proper work-performing position.

The drive shaft extends downwardly through passageways formed in primary guide and follower members and through an opening in the work-supporting surface. A prime mover in the form of an electric motor is fixedly mounted adjacent to and below the work-supporting surface and drive transmission means in the form of pulleys and a drive belt connects the motor output with the drive shaft and rotates the drive shaft in any of a variety of vertical positions of the grinding wheel.

The adjustable mounting means further includes positioning means in the form of a stationary support structure that straddles the housing assembly and includes a threaded screw which is threadably mounted on the support structure and connected to the housing assembly. Reversible rotation of the threaded screw member raises and lowers the housing assembly to position the grinding wheel in the desired vertical position. Locking means in the form of a locking nut carried by the threaded screw functions to maintain the housing assembly in its work-performing position.

The ice skate-sharpening apparatus further includes grinding-wheel dressing means in the form of a dressing tool carried by a tool-carrying member that is adjustably mounted on the housing assembly. The tool-carrying member is pivotal between a first inoperative position displaced axially above the grinding wheel and positions in general alignment with the periphery of the grinding wheel with which it is engageable for purposes of dressing the grinding wheel. The tool-carrying member is also movable radially in opposite directions with respect to the grinding wheel to move the dressing tool towards and away from the periphery of the grinding wheel.

Further objects, features, and advantages of the present invention will become apparent from a consideration of the following description when taken in connection with the appended claims and the accompanying drawing in which:

DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
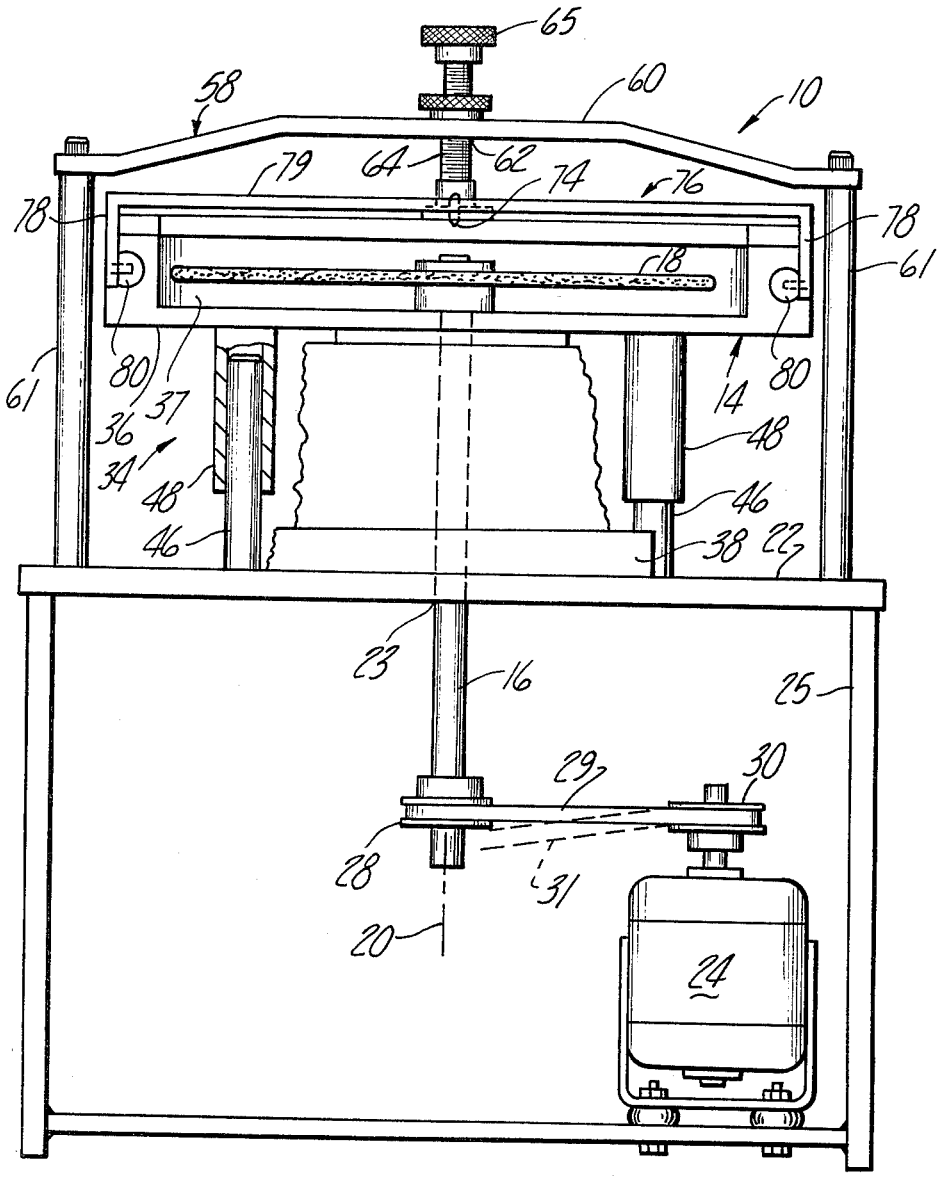
FIG. 1 is a front elevational view of the ice skate-sharpening apparatus of the present invention.

Referring to the drawing, the ice skate-sharpening apparatus of the present invention, indicated generally at 10, is shown in FIG. 1 comprising a housing assembly 14 which carries a drive shaft 16 on which is mounted a grinding wheel 18. The axis of rotation 20 of the grinding wheel 18 and the drive shaft 16 extends in a vertical direction. The housing assembly 14 is adjustably mounted for up and down movement on a work-supporting surface such as the flat work table 22 which is supported by a frame 25. An opening 23 is formed through the work table 22. The drive shaft 16 extends through the opening 23 to positions below the work table 22. A prime mover 24 in the form of an electric motor is fixedly mounted on the frame 25. A pulley 28 is mounted on the drive shaft 16 and a pulley 30 is mounted on the output shaft of the electric motor 24 with a drive belt 29 connecting the pulleys 28 and 30. These components form drive transmission means connecting the output of the prime mover 24 with the drive shaft 16. The drive transmission means operates to rotate the grinding wheel 18 in any of a variety of vertical positions. Thus, up and down movement of the drive shaft 16 and the grinding wheel 18 are accomodated by the pulley and belt arrangement so that the grinding motor 24 can be maintained in a fixed position. As can be seen in FIG. 1 at the broken lines 31, the drive belt 29 will continue to drive the drive shaft 16 when the pulleys 28 and 30 are vertically displaced with respect to each other. Thus, the grinding wheel 18 is isolated from motor vibrations and can be adjusted without movement of the motor 24.

Figure 3:
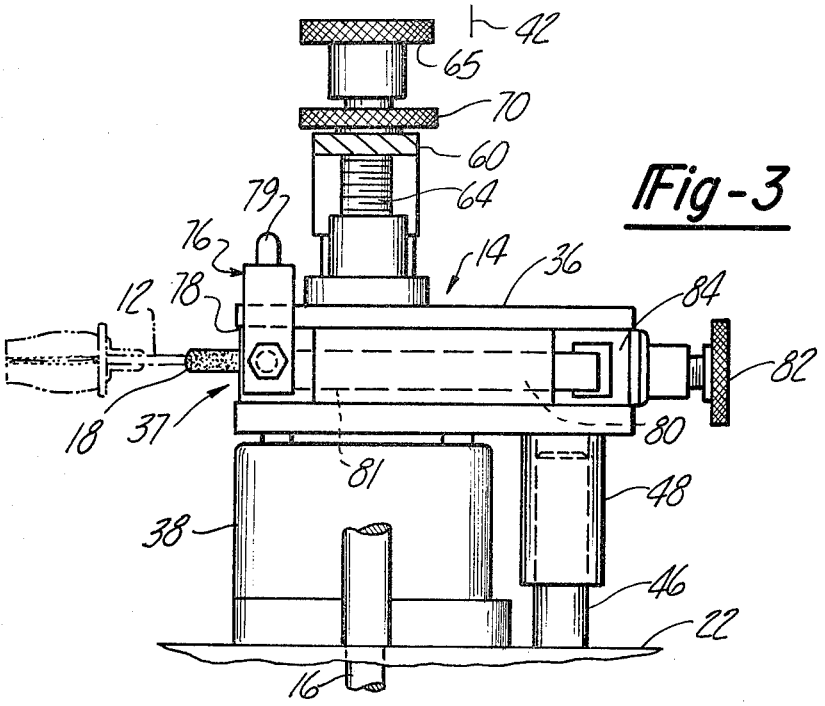
FIG. 3 is a side elevational view of the ice skate-sharpening apparatus shown in FIG. 2 with portions broken away for purposes of clarity.

The housing assembly 14 is adjustably mounted for vertical movement on the work table 22 by adjustable mounting means 34. The housing assembly 14 includes a casing 36 which substantially surrounds the grinding wheel 18 insuring safe grinding of the ice skate blade 12 (FIG. 3). An opening 37 (FIG. 3) is provided in the casing 36 through which a portion of the grinding wheel 18 protrudes allowing the ice skate blade 12 to engage the grinding wheel 18.

The adjustable mounting means 34 includes a primary or hollow tubular guide member 38 (FIG. 2) which consists of a hollow cylindrical tube that is fixedly mounted on the work table 22. The primary guide member 38 has an upright passageway 40 communicating with the opening 23 and has an upright axis 42 that coincides with the upright axis 20. The casing 36 carries a primary follower member 44 having a hollow cylindrical construction similar to the construction of the primary or hollow tubular guide member 38 except that the outer diameter of the primary follower member 44 corresponds to the inner diameter of the guide member 38 enabling the follower member 44 to be slidably telescoped into the guide member 38. The primary follower member 44 also has an upright axis that coincides with the upright axes 20 and 42. Auxiliary upright guide or pin members 46, of which three are employed, are mounted on the work table 22. Secondary follower members in the form of hollow sleeves 48 are carried by the housing assembly 14 and are slidably telescoped with the guide members 46 providing for only vertical movement of the housing assembly relative to the work table. As seen with reference to FIGS. 2 and 3, the auxiliary guide and follower members 46 and 48 are arranged on both sides and rearwardly of the primary guide and follower members 38 and 44 to define a triangle. This arrangement insures that only vertical movement of the housing assembly will occur free of undesirable tilting.

Figure 2:
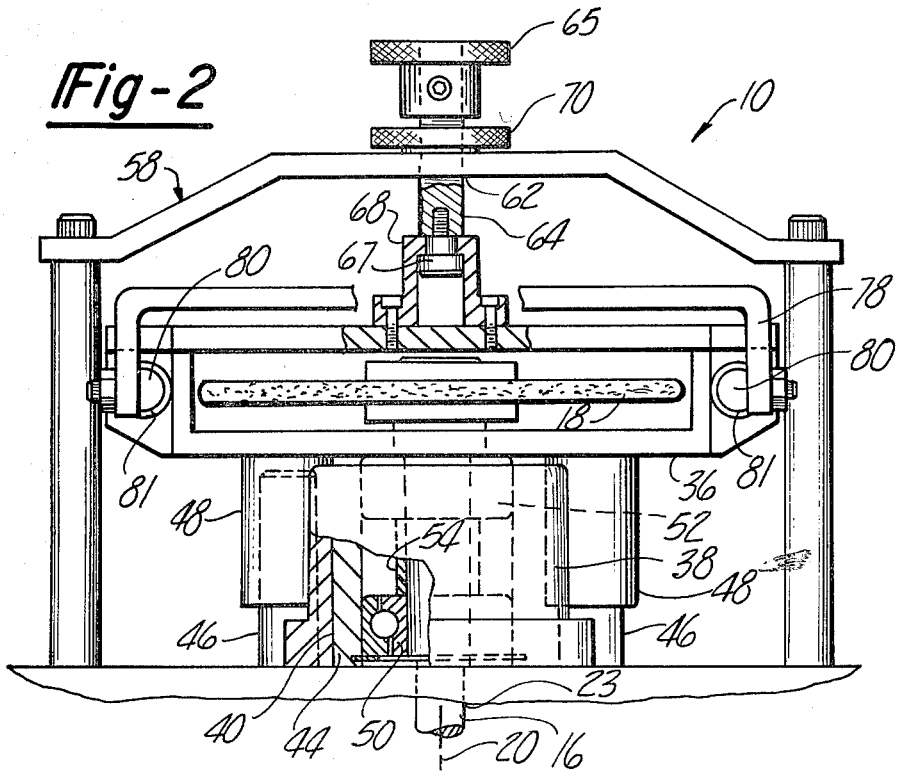
FIG. 2 is an enlarged elevational view of the ice skate-sharpening apparatus shown in FIG. 1, illustrating in greater detail the components thereof.

The drive shaft 16 is rotatably mounted on the housing assembly 14, as can best be seen in FIG. 2, but a pair of spaced-apart bearings 50 and 52 that are axially positioned in the passageway of the follower 44. A spacer 54 maintains the axial spacing between the bearings 50 and 52 which cooperate to support the drive shaft 16 and the grinding wheel 18 on the housing assembly 14 for rotation about the upright axis 20. The bearings 50 and 52 are press fitted in the follower 44 and tightly engage the drive shaft 16 providing for its rotation and up and down movement coincidental with the movement of the housing assembly 14. Further, the bearings 50 and 52 cooperate to maintain the vertical stability of the drive shaft 16 and hence the grinding wheel 18.

The adjustable mounting means further includes positioning means in the form of a stationary support structure comprising an inverted U-shaped assembly 58 which straddles the housing assembly 14. The U-shaped assembly 58 includes a cross bar 60 positioned on upright legs 61 above the housing assembly 14. A threaded bore 62 is formed in the cross bar 60 and receives a threaded screw 64 having a knurled knob 65 allowing manual rotation of the screw 64. The end of the screw 64 is rotatably secured to the housing assembly 14 by means of a screw member 67 which is threaded into the end of the screw 64 which is rotatably received in a cap 68 secured to the casing 36 for slidable movement relative thereto. Accordingly, reversible rotation of the screw member 64 in the bore 62 raises and lowers the housing assembly 14 to locate the grinding wheel in the predetermined work-performing position. Locking means in the form of a nut 70 is threadably mounted on the screw member 64 above the cross member 60. Tightening the nut 70 against the cross member 60 prevents further rotation of the screw member 64 in a direction which would lower the housing assembly 14. Accordingly, the predetermined work-performing position of the grinding wheel 18 is maintained.

The housing assembly 14 also carries wheel-dressing means consisting of a dressing tool 74 (FIG. 1) that is carried by a U-shaped tool-carrying member 76 extending across the housing assembly 14. The member 76 has legs 78 and a main portion 79 that are pivotally mounted to a pair of draw bars 80 slidably disposed in longitudinally extending channels 81 on opposite sides of the housing assembly 14. The draw bars 80 are moved back and forth with respect to the housing assembly 14 by an adjusting mechanism which consists of a screw member 82 that is threadably mounted in a bore formed through an actuator bar 84 that extends across the rear portion of the casing 36 and connects to the draw bars 80 to provide for their simultaneous back and forth movement. The screw member 82 extends through the actuator bar 84 and is connected to the casing 36 in a manner similar to the connection of the screw member 64 to the casing 36. Similarly, the screw member 82 is mounted on the bar 84 in a manner corresponding to the mounting of the screw member 64 to the cross bar 60. Reversible rotation of the screw 82 moves the draw bars 80 and therefore the tool-carrying member 76 back and forth.

The tool-carrying member 76 can be pivoted between an upright inoperative first position as shown in FIG. 3 wherein the dressing tool 74 is displaced axially above the grinding wheel 18 and positions in which the dressing tool 74 is in general alignment with the periphery of the grinding wheel 18. This pivotal movement of the dressing tool 74 along with its radial inward and outward movement provided by the draw bars 80 and the adjusting mechanism enables the grinding wheel 18 to be quickly and easily dressed to maintain the proper wheel surface.

In operation, assume the ice skate 12, as shown in FIG. 3, is mounted on a fixture (not shown) wherein the blade projects in a horizontal direction. The fixture is placed on the work table 22 and is movable to engage the blade with the grinding wheel 18. The threaded screw member 64 is rotated to either raise or lower the grinding wheel 18 so that it is in the precise work-performing position, as shown in FIG. 3; this position, of course, usually varying for different types of skates. The lock nut 70 then is tightened against the cross bar 60 preventing further downward movement of the housing assembly 14. The drive motor 24 is actuated and the sharpening operation is performed. Because the drive transmission means comprises the pulley and belt arrangement, the grinding wheel 18 can be raised and lowered without shutting down the motor which, as explained earlier, is maintained in a fixed position. In this manner, the precise vertical position of the grinding wheel 18 relative to the ice skate blade can be quickly established and adjusted. When the grinding wheel 18 requires dressing, the member 76 is pivotted forwardly and downwardly to bring the dressing tool 74 in alignment with the grinding surface of the wheel 18. The screw member 82 is then actuated to move the tool 74 towards and away from the wheel 18 to properly dress it.

From the above description, it can be seen that the present invention provides an improved ice skate-sharpening apparatus in which the grinding wheel 18 can be accurately and quickly moved vertically relative to the work table 22 to predetermined work-performing positions. The adjusting movement of the grinding wheel is performed without any movement of the drive motor 24 thereby minimizing the effort and complex mechanisms that would otherwise be required. The vibrations of the motor 24 are isolated from the grinding wheel insuring that the ice skate blade is properly sharpened. Provision of the grinding-wheel dressing tool on the housing assembly decreases the time required for accurate dressing of the grinding wheel 18.

What is claimed:

1. Ice skate-sharpening apparatus comprising means defining a horizontal work-supporting surface having an opening extending vertically therethrough, a drive shaft extending vertically through said opening and having a vertical axis of rotation, a grinding wheel positioned for rotation in a generally horizontal plane and mounted on said drive shaft for rotation therewith, a grinding wheel housing assembly supporting said grinding wheel and said drive shaft for rotation for the grinding wheel in said horizontal plane, adjustable mounting means supporting said housing assembly for vertical movement with respect to said work-supporting surface to position said grinding wheel at any one of a plurality of selected work-performing positions above said work-supporting surface, said adjustable mounting means including a hollow tubular guide member spaced radially outwardly from and enclosing said shaft and fixedly mounted on said work-supporting surface, a hollow tubular follower member telescoped with said hollow tubular member for guided vertical movement relative thereto and connected to said drive shaft for vertical movement therewith, and vertical positioning means mounted on said work-supporting surface and connected to said housing assembly for vertically positioning said housing assembly and thereby said grinding wheel relative to said work-supporting surface, a prime mover for rotating the grinding wheel, said prime mover being mounted beneath said work-supporting surface in a fixed position essentially vibrationally isolated from said grinding wheel and said adjustable mounting means, drive transmission means connecting said prime mover with said drive shaft for rotation of said drive shaft and thereby said grinding wheel in any of said plurality of selected work-performing positions, said drive transmission means being connected at one end to said drive shaft and at the other end to said prime mover, said one end being freely movable vertically together with said drive shaft, said adjustable mounting means being mounted on said work-supporting surface and on said housing assembly and being operable to adjust the vertical position of said housing assembly and thereby said grinding wheel relative to said work-supporting surface so that an ice skate blade can be supported at a fixed elevation on said work-supporting surface and the position of said grinding wheel can be adjusted relative to the blade to enable the blade to be sharpened in an optimum manner.

2. The ice skate-sharpening apparatus that is defined in claim 1, wherein said adjustable mounting means includes a plurality of additional guide members fixedly mounted on said work-supporting surface and located radially outwardly from said first guide member, and a plurality of follower members mounted on said housing assembly, each of said follower members being interfitted in a telescoping relationship with an associated one of said guide members to permit vertical movement of said housing assembly relative to said work-supporting surface and to provide additional stability for said housing assembly.

3. The ice skate-sharpening apparatus that is defined in claim 1, wherein said positioning means includes an inverted U-shaped support structure having its lower ends mounted on said work-supporting surface and its upper portion bridging over said housing assembly, and a threaded member threadedly mounted in said upper portion and connected to said housing assembly, said threaded member being rotatable to vary the vertical height of said housing assembly.

4. The ice skate-sharpening apparatus that is defined in claim 3, wherein said adjustable mounting means includes locking means engageable with said threaded member and said support structure for restraining movement of said threaded member to maintain said housing assembly in a predetermined vertical position.

5. The ice skate-sharpening apparatus that is defined in claim 1, wherein said hollow tubular guide member has an axis coinciding with said vertical axis, said hollow tubular follower member having a passageway with an axis also coinciding with said vertical axis, and bearing means disposed in said hollow tubular follower member for maintaining said drive shaft in an axially fixed position relative to said housing assembly so that said drive shaft is moved axially coincidentally with said housing assembly.

6. The ice skate-sharpening apparatus that is defined in claim 1, including grinding-wheel dressing means, said grinding-wheel dressing means including a dressing tool, and a tool-carrying member on which said dressing tool is mounted, means mounting said tool-carrying member on said housing assembly for pivotal movement between a position in which said tool is displaced axially from said grinding wheel and positions in which said tool is in general alignment with the periphery of said grinding wheel, said means mounting said tool-carrying member also providing for the longitudinal movement of said tool-carrying member toward and away from said grinding wheel so that said dressing tool can engage and dress said grinding wheel.

7. The ice skate-sharpening apparatus that is defined in claim 6, wherein said mounting means for said tool-carrying member is operable to move said tool-carrying member generally radially toward and away from said grinding wheel so that said dressing tool can engage and dress said grinding wheel.

* * * * *